US008985982B2

(12) United States Patent
Patterson

(10) Patent No.: US 8,985,982 B2
(45) Date of Patent: Mar. 24, 2015

(54) ROTARY PUMP WITH A VANE PROVIDED IN EACH PUMP OUTLET

(75) Inventor: Albert W. Patterson, West Lorne (CA)

(73) Assignee: 1564330 Ontario Inc., West Lorne, Ontario (CA)

( * ) Notice: Subject to any disclaimer, the term of this patent is extended or adjusted under 35 U.S.C. 154(b) by 0 days.

(21) Appl. No.: 13/989,919

(22) PCT Filed: Nov. 28, 2011

(86) PCT No.: PCT/CA2011/001305

§ 371 (c)(1),
(2), (4) Date: May 28, 2013

(87) PCT Pub. No.: WO2012/083421

PCT Pub. Date: Jun. 28, 2012

(65) Prior Publication Data

US 2013/0259730 A1 Oct. 3, 2013

Related U.S. Application Data

(60) Provisional application No. 61/417,637, filed on Nov. 29, 2010.

(51) Int. Cl.
*F01C 1/00* (2006.01)
*F03C 2/00* (2006.01)
(Continued)

(52) U.S. Cl.
CPC ..... *F04C 18/00* (2013.01); *F04C 2/3566* (2013.01); *F04C 15/066* (2013.01); *F04D 29/2238* (2013.01); *F04C 2240/20* (2013.01)
USPC ..... 418/236; 418/249; 418/15

(58) Field of Classification Search
CPC ..... F01C 1/063; F01C 1/46; F01C 1/3564; F01C 21/18; F01C 21/0809; F04C 2/3566; F04C 15/06; F04C 15/066; F04C 29/12; F04C 2240/20
USPC ..... 418/249, 243, 236, 15, 63
See application file for complete search history.

(56) References Cited

U.S. PATENT DOCUMENTS 832,848 A * 10/1906 Croston ..... 418/249
888,806 A * 5/1908 Hopkins ..... 418/249
(Continued)

FOREIGN PATENT DOCUMENTS

DE 102009006453 A1 7/2010
GB 2207703 A * 2/1989 ..... 418/243
WO 2010/009603 A1 1/2010

OTHER PUBLICATIONS

International Search Report of PCT/CA2011/001305.

*Primary Examiner* — Theresa Trieu
(74) *Attorney, Agent, or Firm* — Caesar, Rivise, Bernstein, Cohen & Pokotilow, Ltd.

(57) ABSTRACT

A pump housing has a cylindrical interior surface having outlets and a pair of side surfaces defining, in combination with the interior surface, a substantially cylindrical chamber. The surfaces have inlets. A rotor has a void, lobes and, for each lobe, a throughpassage. The rotor is positioned in the chamber such that the void communicates with the inlet to receive fluid and the throughpassage for each lobe provides communication between the void and chamber. The rotor is rotatably mounted in the chamber such that the lobes traverse the cylindrical surface. Provided for each outlet is a vane. As the rotor turns, the rotor outer surface is traversed by the vane to create, as the vane traverses a throughpassage, a chamber ahead of the vane which increases in volume and communicates with the throughpassage, and a chamber behind the vane which decreases in volume and communicates with the outlet port.

6 Claims, 6 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 2/356*** | (2006.01) |
| ***F04C 15/06*** | (2006.01) |
| ***F04D 29/22*** | (2006.01) |

(56) References Cited

U.S. PATENT DOCUMENTS

| | | | | |
|---|---|---|---|---|
| 1,489,416 | A | 4/1924 | Anderson | |
| 4,086,042 | A * | 4/1978 | Young | 418/249 |
| 5,833,444 | A * | 11/1998 | Harris et al. | 418/249 |

* cited by examiner

ROTARY PUMP WITH A VANE PROVIDED IN EACH PUMP OUTLET

FIELD OF THE INVENTION

The present invention relates to the field of pumps.

BACKGROUND OF THE INVENTION

It is well known to use pumps to create flows of fluids such as liquids, and numerous types of pumps are known in the prior art, including vane pumps, self-priming pumps and centrifugal pumps.

SUMMARY OF THE INVENTION

Forming one aspect of the invention is a pump. The pump includes a housing having a cylindrical interior surface having one or more outlet ports defined in the housing. The housing has a pair of side surfaces defining, in combination with the cylindrical interior surface, a substantially cylindrical central chamber, the pair of side surfaces having one or more inlet ports defined in the housing. The pump further includes a rotor having a central void, one or more lobes and, for each lobe, a throughpassage. The rotor is positioned in the central chamber such that the central void is in communication with the one or more inlet ports to receive fluid therefrom and such that the throughpassage for each lobe provides for communication between the central void and the central chamber. The rotor is mounted for rotation in the chamber such that the lobes traverse the cylindrical interior surface during rotation. The pump further includes, for each of the one or more outlet ports, a vane. As the rotor turns in the chamber, the outer surface of the rotor is traversed by the vane to, in combination with the rotor and the housing, create, as the vane traverses a throughpassage, a chamber ahead of the vane which increases volume and communicates with the throughpassage, and a chamber behind the vane which decreases in volume and communicates with each outlet port. The pump further includes a valve arrangement adapted to block flow into the chamber via each outlet port at least when the vane for each outlet port is traversing a throughpassage.

According to another aspect of the invention, the vane can be mounted for reciprocating motion in a slot.

According to another aspect of the invention, the valve arrangement can be a check valve.

According to another aspect of the invention, the rotor can be an impeller which, in use, draws fluid through the one or more inlet ports into the central void.

According to another aspect of the invention, the rotor can have two lobes and the housing can have two outlet ports.

According to another aspect of the invention, the rotor can have three lobes and the housing can have four outlet ports.

DETAILED DESCRIPTION

Figure 1:
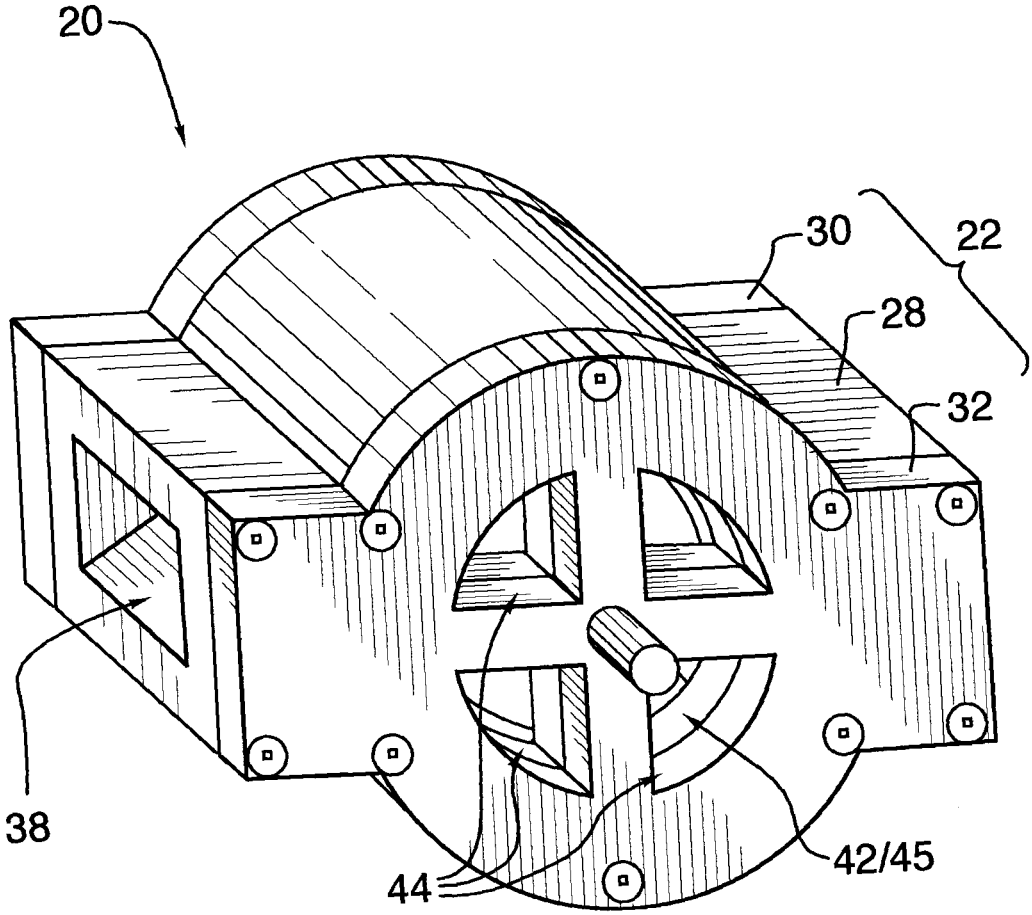
FIG. 1 is a perspective view of a pump according to an exemplary embodiment of the invention.
Figure 2:
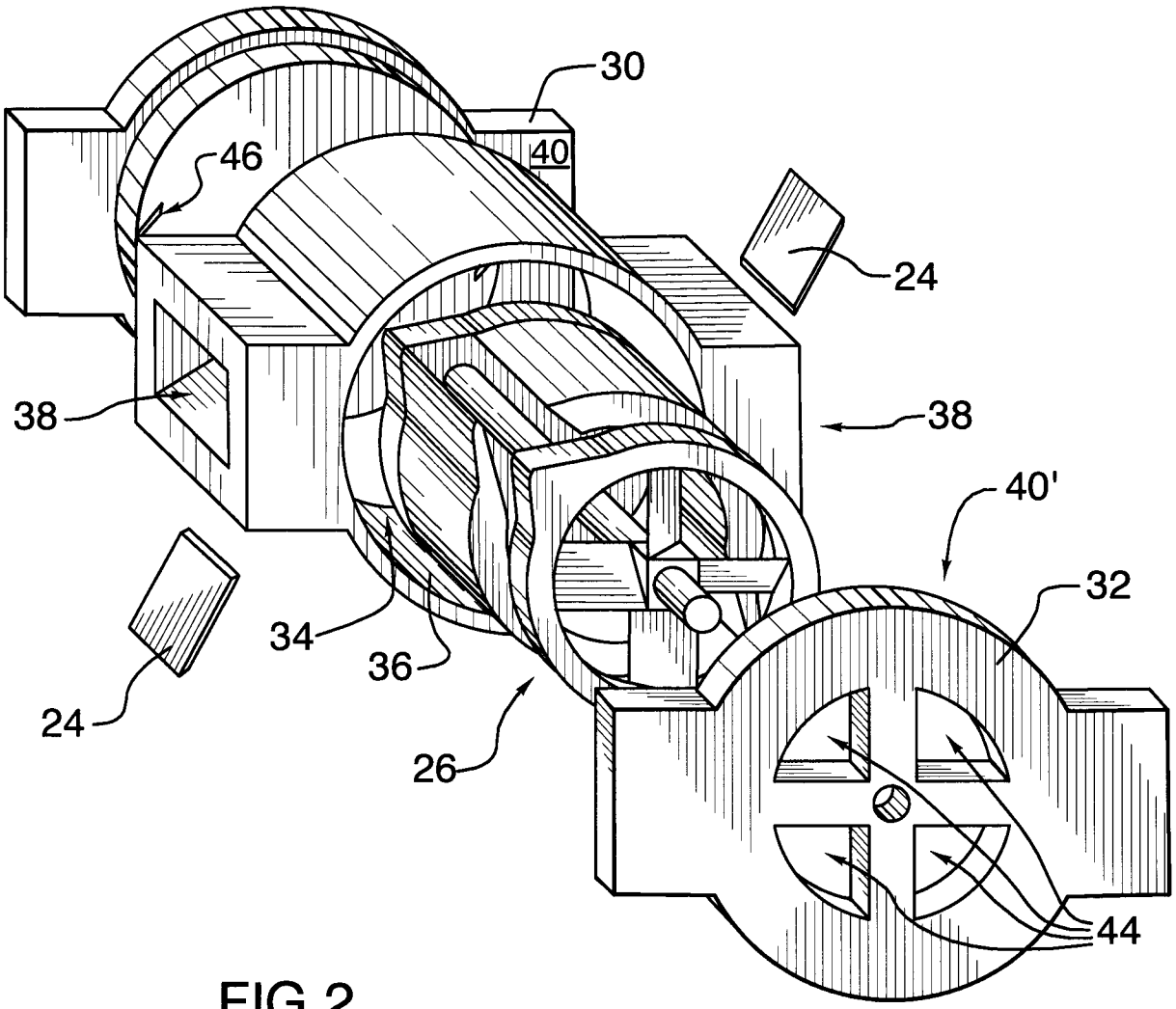
FIG. 2 is an exploded view of the structure of FIG. 1.

A pump 20 according to an exemplary embodiment of the invention is shown in FIG. 1 and, with reference to FIG. 2, will be seen to comprise a housing 22, a plurality of vanes 24 and a rotor 26.

The housing 22 has a main body 28 and a pair of side plates 30,32. The main body 28 has a hollow 34 defined by a cylindrical interior surface 36. Outlet ports 38 punctuate the interior surface 36 and lead through the main body 28. The side plates 30,32 each have a side surface 40,40' which collectively define, in combination with the cylindrical interior surface 36, a cylindrical central chamber 42. One of the side surfaces 40' has an inlet port 44 defined therein leading into the central chamber 42.

Figure 3:
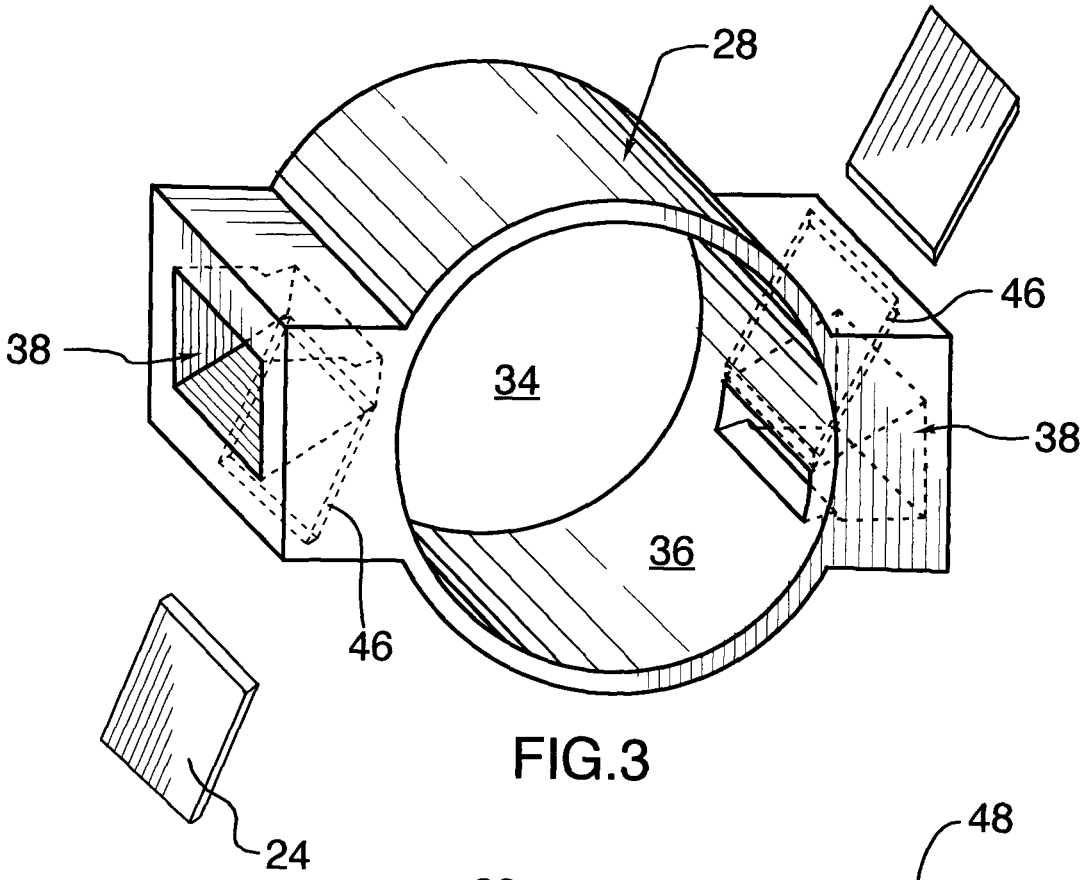
FIG. 3 is an enlarged view of a portion of the structure of FIG. 2.

The vanes 24 are provided one for each outlet port 38, each vane 24 being mounted for reciprocating motion in an adjacent slot 46, the slots 46 being shown in phantom in FIG. 3. The slots 46 are also formed partly in the side plates 30,32, as seen in FIG. 2.

Figure 4:
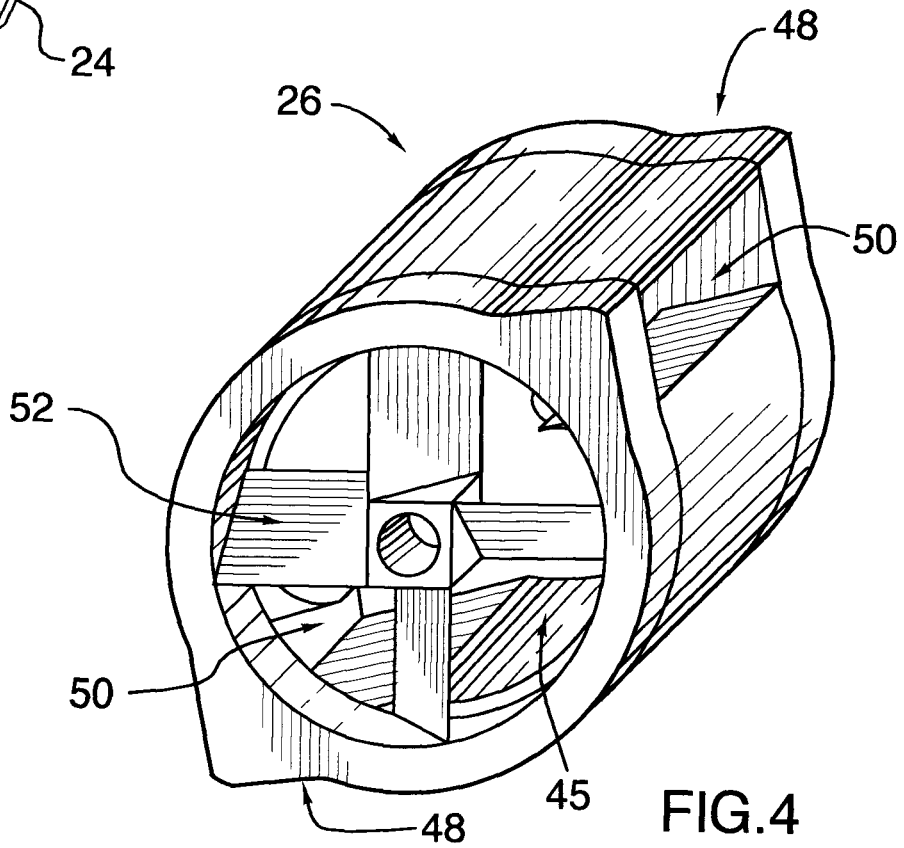
FIG. 4 is an enlarged view of another portion of the structure of FIG. 2.
Figure 5:
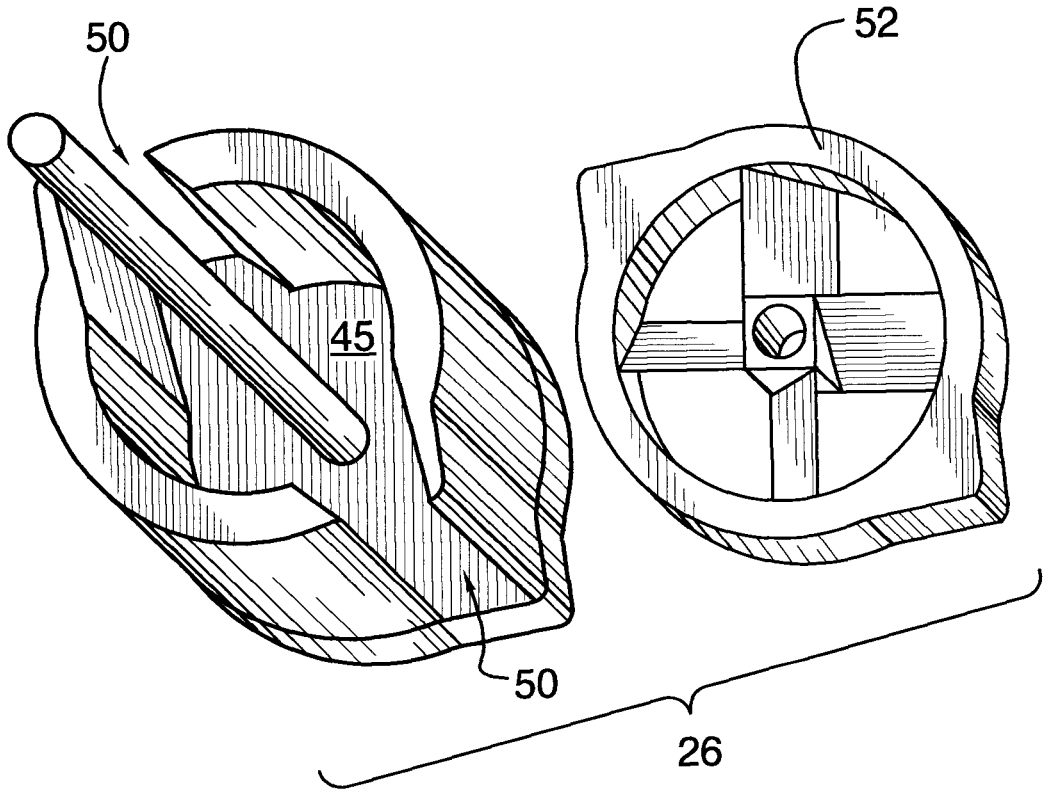
FIG. 5 is an exploded view of the structure of FIG. 4.

The rotor 26, which is mounted for rotation in said central chamber 42, will be seen in FIG. 4 to have a central void 45, a plurality of lobes 48 and, for each lobe, a throughpassage 50. One side of the rotor 26 defines an impeller 52.

The position of the rotor 26 provides for communication between the central void 45 and the central chamber 42 via the throughpassages 50.

FIGS. 6-9 show the pump 20 in a mode of operation and in schematic form and in these views it will be seen that the vanes 24 are positioned, orientated and move in use such that, as the rotor 26 turns in the chamber 42, the outer surface of the rotor 26 is traversed by the vanes 24 without binding and the cylindrical interior surface 36 is traversed by the lobes 48.

Figure 6:
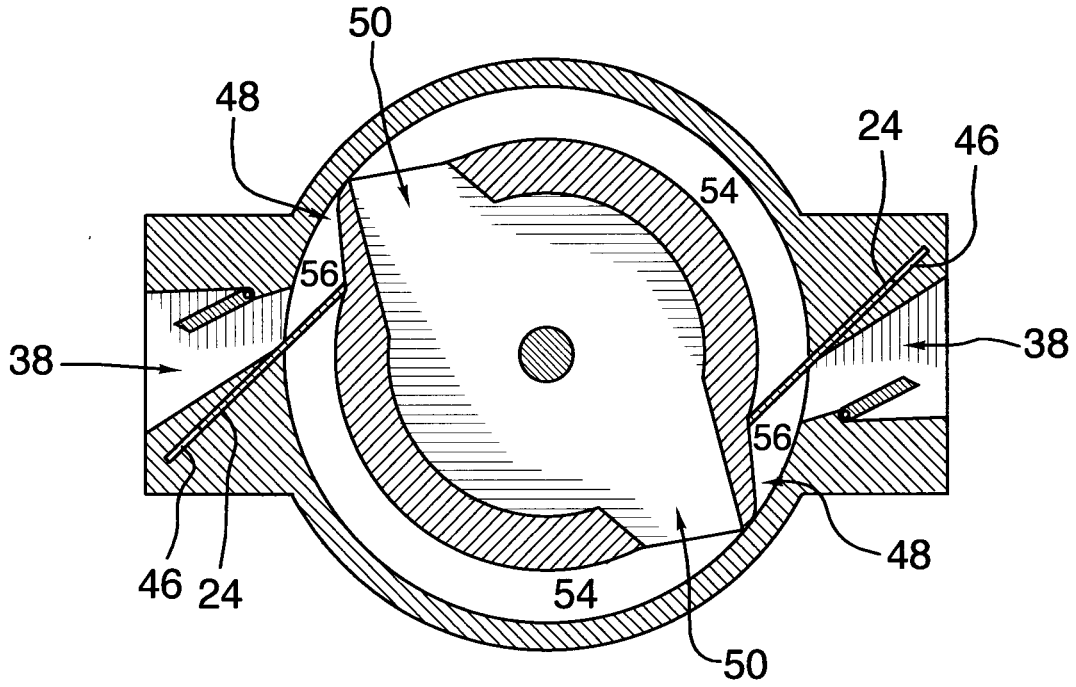
FIG. 6 is a schematic cross-section of the pump in use.
Figure 7:
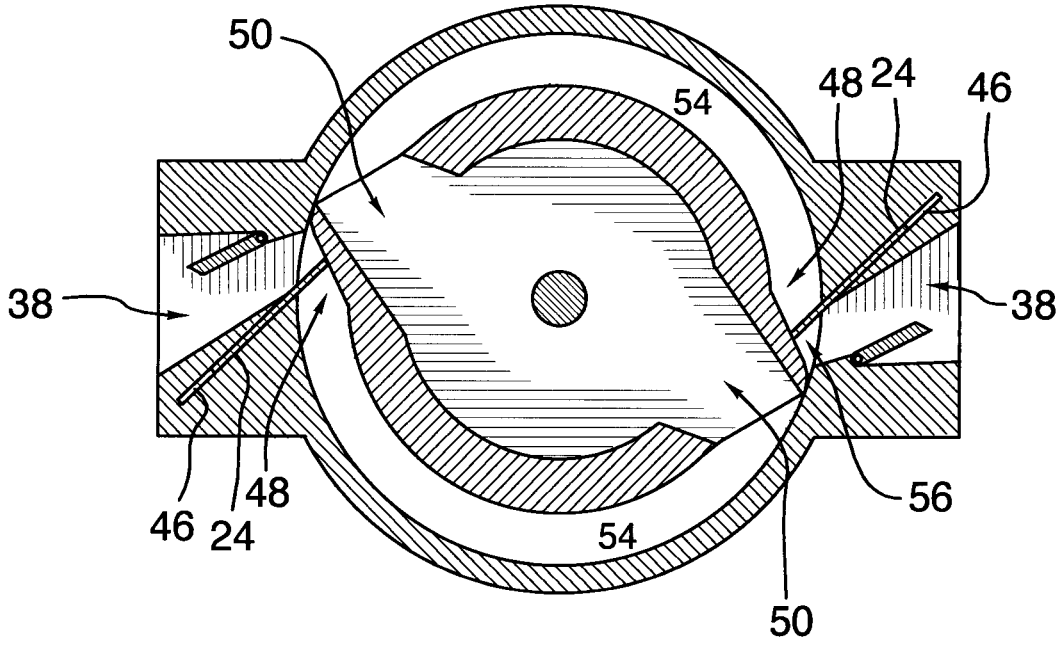
FIG. 7 is a view similar to FIG. 6 with the rotor advanced slightly counterclockwise relative to its position in FIG. 6.

Further, during said rotation, as each vane 24 traverses a throughpassage 50, i.e. as shown by the sequence of FIGS. 6-7, the vane 24, in combination with the rotor 26 and the housing 22, creates:

- a chamber ahead of said vane which increases volume and communicates with said throughpassage; and
- a chamber behind said vane which decreases in volume and communicates with said each outlet port The chambers increasing in volume in FIGS. 6,7 are clearly visible and indicated by reference numeral 54. The chambers decreasing in volume are clearly visible in FIGS. 6,7 and indicated by reference numerals 56.

Figure 8:
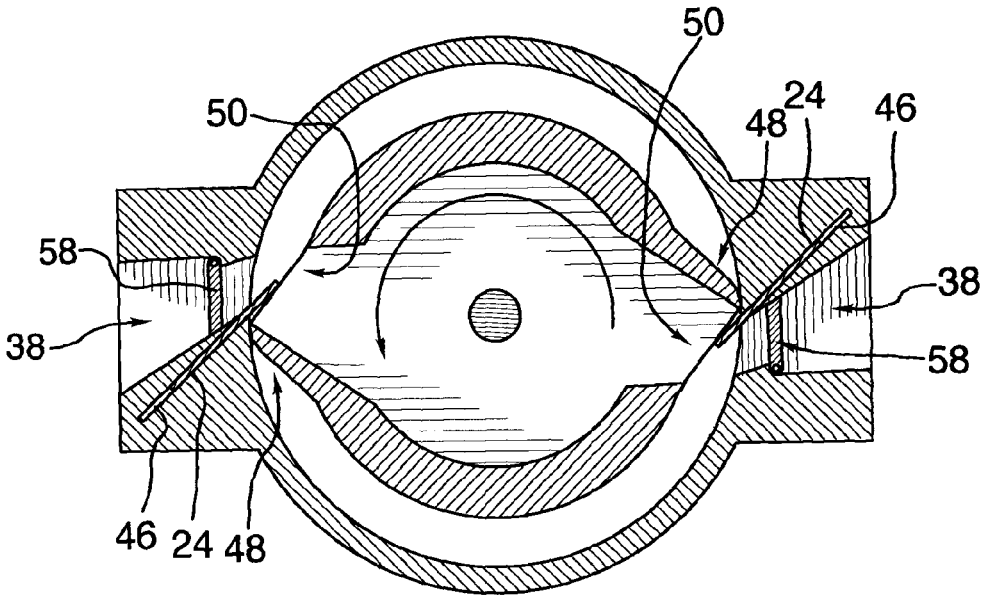
FIG. 8 is a view similar to FIG. 7 with the rotor advanced slightly counterclockwise relative to its position in FIG. 6.

FIG. 8 shows vanes 24 traversing the throughpassages 50, during which process the chambers of increasing volume which communicate with the throughpassages are severed from the throughpassages, coupled to the outlet ports and become chambers of decreasing volume. In this position, it will be seen that neither increasing- nor decreasing-volume chambers are present, as fluid can pass freely across the rotor. In the absence of countermeasures, this could result in backwards flow, which would detract from pump operation. According, a valve arrangement, namely, a plurality of check valves 58, is provided, and adapted to block flow into said chamber 42 via said each outlet port 38 at least when the vane 24 for said each port 38 is traversing a throughpassage 50, i.e. as shown in FIG. 8

In low speed operation, fluid can fill the central chamber by, for example, gravity, and can be forced in a positive displacement manner out the outlets 38 by the lobes 48, as shown by, for example, FIG. 7.

At higher speeds, the impeller 52 can provide substantial assistance in terms of drawing flows into the central chamber 42, i.e. the impeller 52 can draw fluid through the one or more inlet ports 44 into the central void. Displacement of the fluid still occurs via positive displacement.

At very high speeds, the vanes can be drawn into the slots [not shown], and fluid flow via the outlet ports can occur as a result of centrifugal force imparted to the fluid as it passes through the rotor.

Thus, the present invention permits the construction of a self-priming pump that is capable of transitioning between positive displacement and centrifugal operation. The pump is relatively inexpensive to construct and is relatively robust.

The manner of actuating the vanes is not shown nor described. However, persons of ordinary skill will readily appreciate that vane actuation can, for example, be affected at least by hydraulic or pneumatic means, by mechanical linkages and springs. Accordingly, a detailed description is neither required nor provided.

Whereas but a single embodiment is shown and described in FIGS. 1-8, variations thereon are possible.

Figure 9:
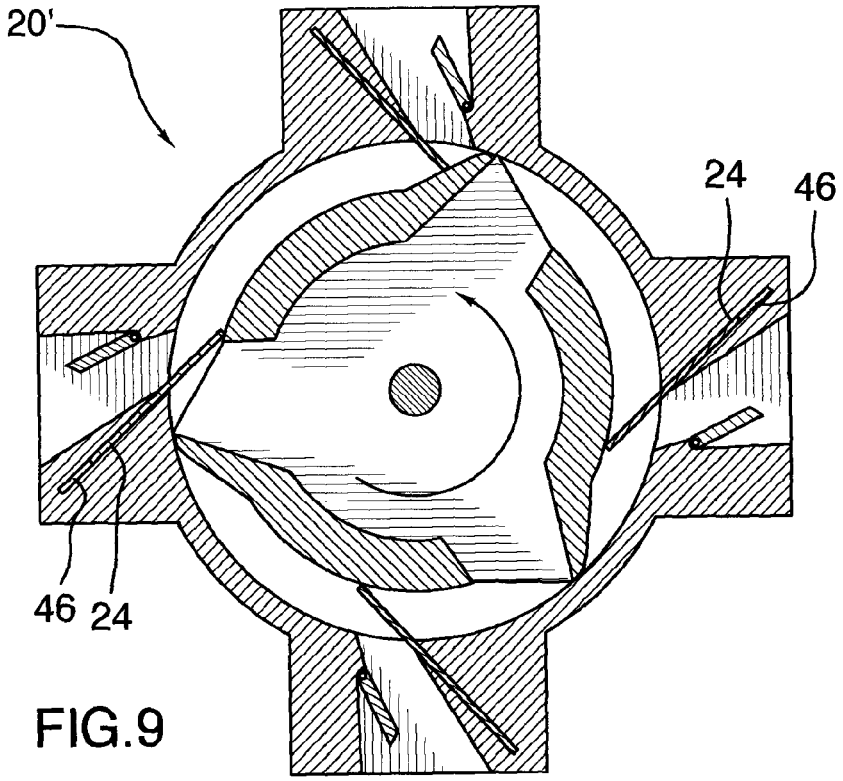
FIG. 9 is a view similar to FIG. 6 but showing a pump according to another exemplary embodiment of the invention.

For example, whereas a plurality of vanes and outlet ports are shown, greater or lesser numbers can be provided. FIG. 9, for example, shows an embodiment 20' having three lobes and four outlet ports. Variation in the numbers of lobes and ports can change the frequency and severity of flow pulses, as persons of ordinary skill in the art will readily understand.

Yet further variations are possible.

Accordingly, the pump should be understood as limited only by the accompanying claims, purposefully construed.

The invention claimed is:

1. A pump comprising:

a housing having a cylindrical interior surface having one or more outlet ports defined therein and a pair of side surfaces defining, in combination with the cylindrical interior surface, a substantially cylindrical central chamber, said pair of side surfaces having one or more inlet ports defined therein;

a rotor having a central void, one or more lobes and, for each lobe, a throughpassage, the rotor being positioned in said central chamber such that the central void is in communication with the one or more inlet ports to receive fluid therefrom and such that the throughpassage for said each lobe provides for communication between the central void and the central chamber, the rotor being mounted for rotation in the central chamber such that the lobes traverse the cylindrical interior surface during said rotation, the rotor being mounted for rotation in a first direction about a longitudinal axis of the central chamber;

for each of said one or more outlet ports, a vane, wherein, as the rotor turns in the central chamber in the first direction, the outer surface of the rotor is traversed by the vane to, in combination with the rotor and the housing, create, as the vane traverses the throughpassage a chamber ahead of said vane, in the first direction of rotation of the rotor which increases volume and communicates with said throughpassage and a chamber behind said vane, opposite the first direction, which decreases in volume and communicates with said each outlet port; and a valve arrangement adapted to block flow into said central chamber via said each outlet port at least when the vane for said each outlet port is traversing the throughpassage.

2. A pump according to claim 1, wherein the vane is mounted for reciprocating motion in a slot.

3. A pump according to claim 1, wherein the valve arrangement is a check valve.

4. A pump according to claim 1, wherein the rotor comprises an impeller which, in use, draws fluid through the one or more inlet ports into the central void.

5. A pump according to claim 1, wherein the rotor has two lobes and the housing has two outlet ports.

6. A pump according to claim 1, wherein the rotor has three lobes and the housing has four outlet ports.

* * * * *